United States Patent [19]

Neumann et al.

[11] 3,987,137

[45] Oct. 19, 1976

[54] METHOD OF MAKING A DIRECT INKING PLATEN

[75] Inventors: Edward W. Neumann, Poughkeepsie, N.Y.; William C. Thomas, Raleigh, N.C.

[73] Assignee: International Business Machines Corporation, Armonk, N.Y.

[22] Filed: Feb. 27, 1975

[21] Appl. No.: 553,718

Related U.S. Application Data

[60] Division of Ser. No. 438,113, Jan. 30, 1974, Pat. No. 3,898,360, and a continuation of Ser. No. 220,956, Jan. 26, 1972, abandoned.

[52] U.S. Cl. ..... 264/113; 264/122; 264/126; 101/401.1

[51] Int. Cl.[2] ..... D04H 1/16

[58] Field of Search ..... 264/126, 122, 113; 101/401.1

[56] References Cited

UNITED STATES PATENTS

| | | | |
|---|---|---|---|
| 2,852,485 | 9/1958 | Stott et al. | 264/122 |
| 3,048,537 | 8/1962 | Pall et al. | 264/126 |
| 3,336,244 | 8/1967 | Rockoff | 264/126 |
| 3,354,247 | 11/1967 | Zehender et al. | 264/122 |

*Primary Examiner*—Robert F. White
*Assistant Examiner*—James R. Hall
*Attorney, Agent, or Firm*—Edward H. Duffield

[57] ABSTRACT

A method of making an inking platen suitable for use with impact printers and comprising a unitary microporous nylon body having a thin microporous flexible tough outer skin portion, and a ribbon affixed to the skin; the ribbon being woven of nylon fibers, the body being compression molded from a predetermined particulate nylon blend of a minority of high mesh nylon and the remainder of low mesh nylon.

1 Claim, 1 Drawing Figure

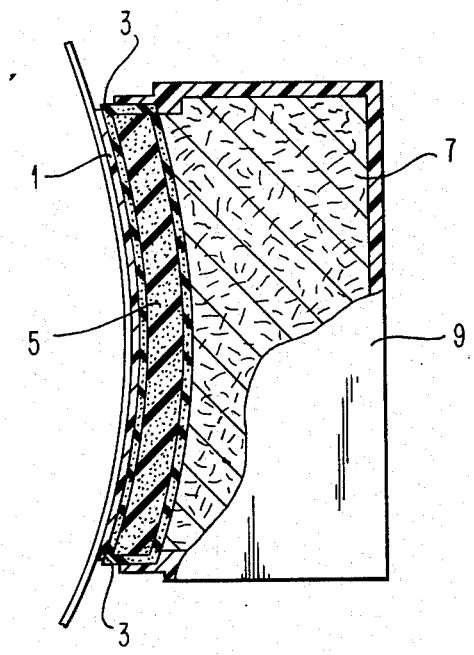
3
1
7
5
9
3

METHOD OF MAKING A DIRECT INKING PLATEN

This is a division of application Ser. No. 438,113 filed Jan. 30, 1974 now U.S. Pat. No. 3,898,360, a continuation of Ser. No. 220,956 filed Jan. 26, 1972 now abandoned.

BACKGROUND OF THE INVENTION

This invention relates to a method of making direct inking platen, and more particularly to improvements in the ink flow, wear resistance, and print definition characteristics thereof.

In the prior art, impact printers would either urge an inking surface toward the paper or vis a' vis. In U.S. Pat. No. 2,414,895 issued to M. Reynolds et al on Jan. 28, 1947, an operating bar impacts a porous print element through an ink filled flexible diaphragm-like reservoir. Compression of the reservoir and the mechanical engagement of the print element provided contact with the paper and also served to transfer ink from the reservoir to the print element.

Another form of impact printer termed a wire matrix printer is illustrated in U.S. Pat. No. 3,198,306 to R. A. Bachman on Aug. 3, 1965, and utilizes a plurality of individually operable dot printing elements such as spaced apart parallel wires. The wires are simultaneously projected in combination against an ink ribbon to effect printing of the whole character at once by the ribbon upon the paper. Characteristically, ribbon printing with wires suffers due to wearing of the wires impacting the ribbon and the deterioration of the ribbon due to the shredding of its fibers by the progressively worn and sharpened wires. While the exact mechanism of wearing of the wires is not fully understood, it is believed that it is due to a combination of factors such as chemical and hydraulic etching of the wire ends by the inking medium as well as mechanical impact deformation.

Of course, one approach is to eliminate the ribbon inking medium entirely. This may be accomplished by using self-inking paper. That is, the paper changes color due to localized pressure changes when impacted by the wires. This approach suffers the disadvantage of the high cost of specially treated paper, fragility, and tendency to discolor when mechanically handled.

Admittedly, the prior art is replete with many self-inking sponge-like structures ranging from the rubber used by Reynolds et al to the porous polyamide articles described in U.S. Pat. No. 3,022,542, issued to W. J. Davis on Feb. 27, 1962. Reference should also be made to the porous plastic printing structures shown in U.S. Pat. No. 3,303,146 to P. Chabiniak issued Feb. 7, 1967. The prior art teaches in general terms that an inking platen having microporous structure can be formed from the compression molding of particulate nylon or polyvinylchloride. These sponge-like structures, however, would be proverbially torn to shreds under repeated wire firings in a wire matrix printer, for example. It is also the case that the impacting of sponge-like structures, even with the same force, results in dissimilar quantities of liquid being ejected therefrom. Lastly, such structures frequently have their pores randomly distributed. This means that the print character may lack good definition i.e., the dot print elements lack regular and uniform spacing.

SUMMARY OF THE INVENTION

It is accordingly an object of this invention to devise a method of making a direct inking platen capable of withstanding repeated deformation from impacting printing mechanisms such as a wire firing dot matrix printer. It is a related object that the method should achieve a platen which will resist deformation of its surface, render more uniform the flow of ink, and exhibit improved print definition.

The foregoing objects are satisfied in an embodiment of a direct inking platen comprising a unitary nylon body having microporous interstices and a flexible-tough microporous outer skin, the body being formed from a compression molded particulate nylon blend. A ribbon of woven nylon fibers is affixed to the body, preferably by heat fusion, and both covers and is in contact with the flexible-tough outer skin.

It was unexpectedly discovered that by compression molding a particulate nylon blend containing a calculated minority of high mesh nylon with the remainder of low mesh nylon under a certain range of pressure, temperature, and duration, that a microporous nylon body and microporous flexible-tough outer skin could be formed. The micropores were sufficient to ooze and transport an oil based liquid medium throughout the body by capillary action. The porous flexible-tough outer skin would withstand repeated impacts. Now, if the compression molding conditions or the blend lay outside the critical ranges, then a body having the desired chracteristics cannot be formed. Thus, if the duration of the mold is exceeded, a flexible-tough impervious skin results.

It is noteworthy that the nylon ribbon with its regularly spaced interstices is in intimate contact with the randomly spaced micropores of the flexible-tough skin. The ribbon is of sufficient thickness to wick the oil based liquid (ink) from the micropores to the other side of the ribbon. When paper is suddenly urged against the ribbon by an impacting means, (hammer, wires) then good definition is achieved by the uniform ribbon ink filled interstices. Liquid flow is controlled by the hydrostatic pressure between the ink filled ribbon and the micropores. Significantly, upon impact, the body skin deforms without tearing or shredding absorbing the impact energy. The body and skin possess sufficient resilience to return to their former shape when the impact or printing element is removed.

BRIEF DESCRIPTION OF THE DRAWING

The FIGURE is a cutaway side view of the inking platen resulting from the method according to the invention.

DESCRIPTION OF THE PREFERRED EMBODIMENT

The best mode for practicing the invention contemplates forming a nylon body from compression molding a particulate blend of nylon 6, 6. In this regard, nylon 6, 6 is understood to mean the polymer formed from the reaction product of hexamethylenediamine and hexane dioic acid. The resulting polymer possesses a melting point between 493° F and 500° F, and a nominal molecular weight of 17,500.

Bulk nylon is rendered into particles by milling or grinding. Particle size is determined by taking the ground particles and pouring them through a nest of sieves having progressively smaller apertures (increasing mesh size). The grinding and passing through the sieve occur at the same time. The sieve analysis consists of taking a measured amount of material and placing it in the topmost (coarsest) sieve and then shaking the material through the progressively finer openings. The residue at each sieve stage constitutes material coarser than the given mesh opening. Thus, nominal eighty mesh material comprises material 75% by weight lying between 400 $\mu$ and 150 $\mu$. Likewise, nominal 20 mesh material is 75% by weight of material between 420 $\mu$ and 300 $\mu$.

Now, it has been observed, also, that a structure obtained from the compression molding of a blend of different particle size nylon varies in the size of the interstitial spaces. Further, if large and small particles are mixed (blended) then the filled volume (packing fraction) can be increased. Relatedly, the degree of re-enforcement for structural purposes is a function of filled volume. The justification for a particular blend is that it provides the optimum interstitial space. In the preferred embodiment, the interstitial space was of a size sufficient to transport an oil based ink of viscosity between 100 to 125 centipoises at a temperature between 40° F to 125° F by capillary action. Consequently, while all dye stuff based inks may be used, it is not expected that pigmented inks could be employed. Pigmented inks, in contrast with dystuff inks, contain ground up solids such as carbon black dispersed in a vehicle. Any concentration of the solids tends to clog the micropores, thereby inhibiting ink flow.

With the above background, it is desirable to describe the method according to the invention. In order to form the microporous platen, a particulate blend of approximately 30% nominal eighty mesh nylon and 70% nominal 20 mesh nylon is compression molded for a period between ten to twenty minutes. The pressure upon the molded article varies between about 10,000 to 15,000 psia at a temperature between about 350° F to 420° F. The resulting structure is microporous with a flexible tough microporous thin skin in the order of 1/5000 inches thick therearound. The resilient skin strongly contrasts with the interior which might be best described as crumbly. If the blend is processed in excess of 20 minutes, at a temperature in excess of 420° F, or at a pressure substantially exceeding 15,000 psia, then a non-porous skin is formed. This condition is believed due to formation of a melt of sufficient continuity to eliminate the desired porosity.

By using the optimum compression molding conditions, a porous tough thin skinned platen containing and supporting a weak structured interior is obtained. The skin exhibits a resilience and absorbs and dissipates the repeated point impact of an 11 mil diameter wire such as is found in a wire matrix printer. The structure has withstood up to 72,000,000 equivalent wire fires of the IBM 2213 Printer. The print head characteristics of this wire matrix printer include a print rate of 66 characters/sec, a character matrix of 5 dots by 7 dots, a hammer mass driving the wires of 0.55 grams, hammer velocity of 80 inches/sec, and a print force of 4 pounds.

A ribbon of woven nylon fibers may be attached to the microporous nylon body by heat fusion for the purpose of controlling ink flow from the outer skin micropores to the printed upon medium (paper); absorbing some of the impact energy, and for improving print definition. A ribbon of nylon weave having a warp count of 183 ± 3.5 lengthwise, fill count 114 ± 3 crosswise, a minimum thread count of 293, and caliper of 0.0033 ± 0.0003 inch was used with good effect.

Referring now to the FIGURE, there is shown a cross-section view of the preferred embodiment. In its contemplated use, the platen forms a directly inked arcuate surface against which selected portions of paper are urged by an impact means such as wires (not shown). A dot printing mechanism, such as a wire cross-section, distorts the paper and deforms the ribbon. To a lesser extent, the supporting flexible tough surface is likewise distorted. Ink which has been wicked through the ribbon is transferred from the ribbon to the paper. Upon removal of the wire, the platen possesses sufficient elastic response to return to its undistorted shape.

The nylon ribbon 1 may be conveniently heat fused to the skin 3 without altering the microporosity of either. The skin entirely surrounds and encloses the crumbly structured microporous interior 5. The nylon body is compression molded into its arcuate shape suitable for fabrication. An ink reservoir made from a suitable fiber filled medium such as felt is positioned on the opposite side of the body. A container 9 adapted to support the inking platen and reservoir may be fashioned from plastic or other material.

The ribbon, in addition to increasing platen life, improves definition due to the regularity of its interstices in contrast to the irregularity or random distribution of the micropores on the skin surface. The ribbon improves the inking efficiency because of its greater surface to volume of ratio permits retention of a quantity of ink. For best results, a ribbon 3 mils thick should be used. It is recalled that as thickness is increased, definition is decreased. Also, as thickness is increased, wear life increases. At the same time as the nylon body inhibits forward movement of the impacting wire, it also serves as an ink reservoir and transfer medium to the ribbon.

The exact nature of the cohesive forces holding the hot pressed nylon together are not well understood. It is believed that the bonding yielding the unexpected results may be due to hydrogen bonding and that the bonding is inter- rather than intramolecular. The nylon particulate blend is hot pressed below its bulk melting point. Conceivably, in the hot pressing of the blend, certain sites on the surface constitute high energy nucleation sites and that adjacent particles would be accordingly joined. It is theorized that, in the embodiment, the number of fusion concentration sites would be in a minority compared to the hydrogen bonding sites. Probably, the hot pressing under the conditions previously set forth does not constitute sintering as that term is used in the art. That is, sintering is the process of making an open (porous) structure by fusing at selected sites under the influence of pressure and temperature. A mechanism analogous to that of the invention is considered to be that of the hydrogen bonding in hot pressed cellulosics.

While the invention has been particularly shown and described as to preferred embodiments thereof, it will be understood by those of skill in the art that various changes in form and detail may be made without departing from the spirit and scope of the invention.

What is claimed is:

1. A method for making a unitary microporous direct inking platen nylon body having a porosity between from about 5% to about 15% and an integral microporous outer skin on the order of 1/5000 inch in thickness, the micropores being sufficient to transport an oil based liquid throughout said body by capillary action, comprising the steps of:

forming a particulate blend of thirty percent nominal eighty mesh nylon 6, 6 with 70 percent nominal 20 mesh nylon 6, 6; and compression molding the blend to achieve particle bonding by pressing said blend for more than ten but less than 20 minutes at a temperature from about 350° F to about 420° F and at a pressure on the blend during molding from about 10,000 psia to about 15,000 psia, thereby forming a unitary, microporous body having an integral microporous outer skin on the order of 1/5000 inch in thickness.

* * * * *